US007798713B2

(12) United States Patent
Blythe et al.

(10) Patent No.: US 7,798,713 B2
(45) Date of Patent: Sep. 21, 2010

(54) POLYMERIC BAGS WITH PRESSURE RELIEF VALVES

(75) Inventors: James S. Blythe, Libertyville, IL (US); Wiliam P. Belias, Pittsford, NY (US); Toby R. Thomas, Pleasant Prairie, WI (US)

(73) Assignee: Pactiv Corporation, Lake Forest, IL (US)

( * ) Notice: Subject to any disclaimer, the term of this patent is extended or adjusted under 35 U.S.C. 154(b) by 1415 days.

(21) Appl. No.: 11/212,356

(22) Filed: Aug. 26, 2005

(65) Prior Publication Data

US 2006/0050999 A1 Mar. 9, 2006

Related U.S. Application Data

(60) Provisional application No. 60/605,082, filed on Aug. 27, 2004.

(51) Int. Cl.
*B65D 33/16* (2006.01)
*B65D 33/01* (2006.01)

(52) U.S. Cl. ..... 383/63; 383/103

(58) Field of Classification Search ..... 383/63, 383/103, 100, 44, 45, 42, 43, 48, 49, 50, 383/94; 206/524.8; 220/913, 89.1, 203.01, 220/721; 251/901, 84; 222/528; 137/843, 137/852, 859

See application file for complete search history.

(56) References Cited

U.S. PATENT DOCUMENTS 1,592,191 A * 7/1926 Etzelt ..... 137/859
2,821,338 A * 1/1958 Metzger ..... 383/94
2,946,502 A * 7/1960 Metzger ..... 383/103
3,133,691 A * 5/1964 Corbett ..... 383/103
3,209,984 A * 10/1965 Pelce ..... 383/44
3,237,844 A * 3/1966 Hughes ..... 383/94
3,322,327 A * 5/1967 Prall ..... 383/58
3,549,298 A * 12/1970 Brockmuller ..... 383/44
4,000,846 A * 1/1977 Gilbert ..... 383/103
4,206,870 A * 6/1980 DeVries ..... 383/103
4,215,725 A * 8/1980 Callet et al. ..... 137/855
D274,602 S * 7/1984 Vangedal-Nielsen ..... D9/703
4,653,661 A * 3/1987 Buchner et al. ..... 383/103
4,949,882 A * 8/1990 Take ..... 222/528
5,326,176 A * 7/1994 Domke ..... 383/103
5,443,851 A * 8/1995 Christie et al. ..... 426/88

(Continued)

FOREIGN PATENT DOCUMENTS

JP 03212355 A * 9/1991

*Primary Examiner*—Jes F Pascua
(74) *Attorney, Agent, or Firm*—Baker Botts LLP

(57) ABSTRACT

Polymeric bag includes first and second opposing body panels attached to each other along a pair of opposing sides and a bottom bridging the sides, a reclosable fastener extending along a mouth formed opposite the bottom, a pressure relief opening defined in the first body panel, and a pressure relief valve attached to the first body panel. The valve includes a cover member to cover the opening. The cover member includes an upper layer and a lower layer, wherein the upper layer is connected at a first end to the lower layer. The lower layer includes a first portion attached to the body panel and a second contiguous portion not attached to the body panel. The first end of the upper layer is hingedly connected to the second portion of the lower layer. An additional aspect includes a seal line extending proximate the pressure relief opening.

21 Claims, 4 Drawing Sheets

U.S. PATENT DOCUMENTS 5,881,881 A * 3/1999 Carrington ..... 383/103
5,989,608 A * 11/1999 Mizuno ..... 220/203.1
5,996,800 A * 12/1999 Pratt ..... 206/524.8
6,461,043 B1 * 10/2002 Healy et al. ..... 383/103
6,662,827 B1 * 12/2003 Clougherty et al. ..... 383/103
6,663,284 B2 * 12/2003 Buckingham et al. ..... 383/103
6,799,680 B2 * 10/2004 Mak ..... 206/524.8
2003/0035597 A1 * 2/2003 Buckingham et al. ..... 383/103
2004/0000501 A1 * 1/2004 Shah et al. ..... 383/63
2004/0007494 A1 * 1/2004 Popeil et al. ..... 206/524.8

* cited by examiner

POLYMERIC BAGS WITH PRESSURE RELIEF VALVES

CROSS-REFERENCE TO RELATED APPLICATIONS

This application claims the benefit of provisional application No. 60/605,082 filed Aug. 27, 2004, the entire content of which is expressly incorporated herein by reference thereto.

FIELD OF THE INVENTION

The present invention relates to plastic and polymeric bags. More specifically, the present invention relates to pressure relief valves and methods for removing air and other gases contained in such bags.

BACKGROUND OF THE INVENTION

A variety of plastic or polymeric bags are well known and used for sundry applications. Generally, a polymeric bag includes first and second opposing body panels that are fixedly attached to each other along a pair of opposing bag sides and a bottom that extends between the pair of bag sides. The body panels, the bag sides, and the bottom define a receptacle space having a mouth formed opposite the bottom.

Many types of polymeric bags include a reclosable fastener extending along the mouth. A common reclosable fastener includes a mating pair of male and female tracks that are releasably engageable to each other to allow the bag to be opened and closed.

Polymeric bags with reclosable fasteners are commonly used by consumers to store food items, such as cheeses and meats, fabric items, such as clothing and dry cleaning, and other items. After closure, such bags often contain air, which can accelerate the spoilage of the food items stored in the bags.

A variety of pressure relief valves are currently available for removing air and other gases from polymeric available for removing air and other gases from polymeric bags. Many of these valves are complicated to construct and difficult to operate and provide unsatisfactory sealing and venting properties, thereby inhibiting their utility.

SUMMARY OF THE INVENTION

Polymeric bags with pressure relief valves having improved sealing and venting properties and methods of using the same are disclosed herein.

Generally, each of the disclosed polymeric bags of the present invention has opposing body panels connected along a pair of opposing sides, a bottom bridging the sides, a reclosable fastener extending along a mouth formed opposite the bottom, and at least one pressure relief valve disposed on one of the body panels. The valve is positioned adjacent a pressure relief opening defined in a body panel of the bag and includes a cover member that covers the opening.

In accordance with one aspect of the invention, the cover member includes an upper layer and a lower layer, in which the upper layer is hingedly connected at a first end to the lower layer. The lower layer includes a first portion attached to the body panel and a second portion which is contiguous with the first portion but not attached to the body panel for relative movement therefrom. The first end of the upper layer is hingedly connected to the second portion of the lower layer. In some embodiments, the upper layer is fixedly attached at a second end to the body panel, whereas in other embodiments, the second end is attached to the lower layer.

In accordance with another aspect of the invention, a bag is provided with a pressure relief opening, a pressure relief valve, and a seal line extending proximate the pressure relief opening. Particularly, the seal line at least partially attaches the first and second body panels of the bag together. The seal line extends from or proximate the pressure relief opening to a location beyond the pressure relief valve. In this manner, when pressure is applied to the bag to open the pressure relief valve, a dimple is formed in the panel proximate the pressure relief valve the enhance the flow of air therefrom. In some embodiments, the seal line extends inwards from a corner of the bag formed in the intersection between one of the opposing bag sides and the bottom. Alternatively, the seal line extends inwards from a corner of the bag formed in the intersection between one of the opposing bag sides and the fastener. The angle of the seal line can be substantially 45 degrees with respect to the one of the opposing bag sides.

In accordance with another aspect of the present invention, the cover member can include further modifications to enhance the seal formed between the cover member and the corresponding panel of the bag. Particularly, the cover member can be provided with surface modifications to effectuate an improved seal. The surface modifications preferably are included on at least the upper layer or the lower layer, if provided. In some embodiments, the first portion of the lower layer includes two or more troughs formed therein. The troughs are concentric with the exit opening and are at least partially filled with a sealing oil. The troughs can be formed thermally.

During a method of operation of each of the disclosed bags of the present invention, one or more items are placed in a bag, the reclosable fastener of the bag is placed in a closed position, and pressure is applied to the opposing body panels of the bag, causing air and other gases to exit the bag through the pressure relief opening. The pressure exerted by the exiting gases causes the cover member to bend, bulge, flex, or otherwise move away from the body panel, which allows the gases to exit through at least one open side of the pressure relief valve. Once returned to its relaxed state, e.g., upon release of the pressure applied to the opposing body panels, the cover member covers and seals the pressure relief opening, inhibiting or preventing flow of air and other gases into and out of the bag.

These and other features of the disclosed polymeric bags of the present invention can be more fully understood by referring to the following detailed description and accompanying drawings, in which similar parts in different drawings are denoted by reference numerals that differ by increments of 100. The drawings are not drawn to scale, but show only relative dimensions.

DETAILED DESCRIPTION

Figure 1:
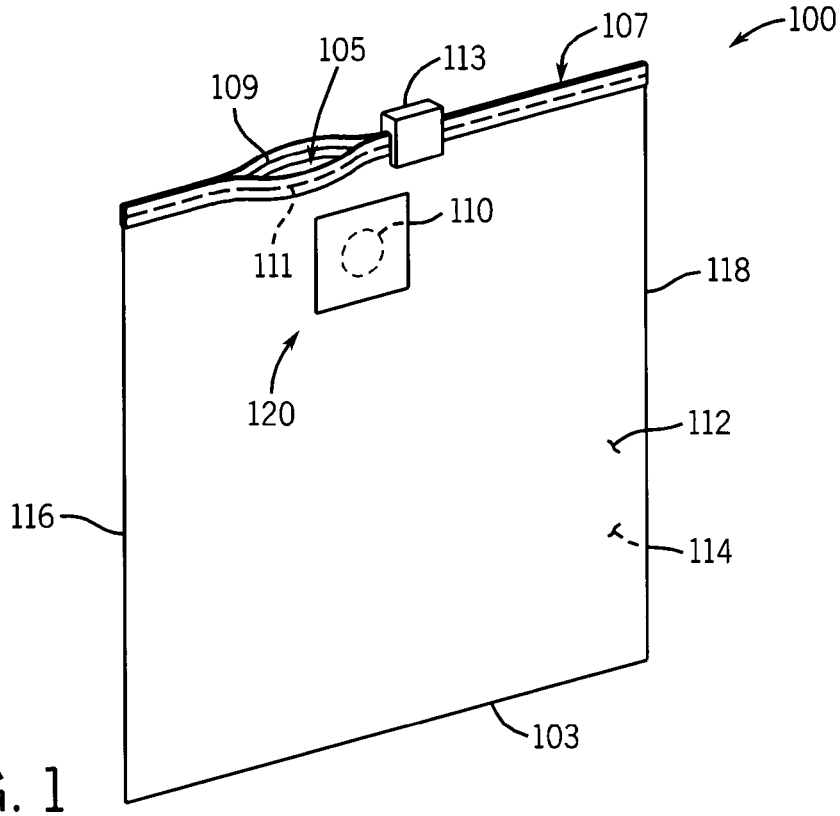
FIG. 1 is a perspective view of a representative embodiment of a polymeric bag including a pressure relief valve of the present invention.

Illustrative embodiments will now be described to provide an overall understanding of the disclosed polymeric bags with pressure relief valves. One or more examples of the illustrative embodiments are shown in the drawings. Those of ordinary skill in the art will understand that each disclosed polymeric bag having a pressure relief valve can be adapted and modified to provide alternative embodiments of polymeric bags with pressure relief valves for other applications, and that other additions and modifications can be made to the disclosed polymeric bags with pressure relief valves without departing from the scope of the present disclosure. For example, features of the illustrative embodiments can be combined, separated, interchanged, and/or rearranged to generate other embodiments. Such modifications and variations are intended to be included within the scope of the present disclosure.

In accordance with the invention, a polymeric bag is provided having opposing body panels connected along a pair of sides and a bottom that extends between the pair of sides. The body panels, the sides, and the bottom define a receptacle space having a mouth formed opposite the bottom. FIG. 1 is a perspective view of a representative embodiment of a polymeric bag including a pressure relief valve. As shown in FIG. 1, the bag 100 includes first and second opposing body panels 112 and 114 fixedly attached to each other along a pair of opposing bag sides 116 and 118 and a bottom 103 that extends between the pair of opposing bag sides 116 and 118. The panels 112 and 114, the sides 116 and 118, and the bottom 103 define a receptacle space having a mouth 105 formed opposite the bottom 103.

Further in accordance with the invention, the bag includes a pressure relief opening defined in one panel and a pressure relief valve in communication therewith.

Particularly, and as embodied herein, the pressure relief valve includes a cover member disposed on the panel to cover the pressure relief opening. For example, and as embodied herein as depicted in FIG. 1, the first body panel 112 defines a pressure relief opening 110. As shown schematically in FIG. 1, a pressure relief valve 120 is positioned adjacent the opening 110 to facilitate venting of air and other gases from the bag 100. A reclosable fastener 107 extends along the mouth 105 of the bag 100 and includes male and female tracks 109 and 111.

Each disclosed polymeric bag with pressure relief valve of the present invention can be formed from a variety of techniques and constructions known to those of ordinary skill in the art. In some embodiments, bag 100 is formed from a single plastic sheet folded upon itself along the bottom 103 and sealed to itself along the opposing bag sides 116 and 118. Alternatively, in some embodiments, bag 100 is formed from two separate plastic sheets that are sealed together after being initially separated so as to form bag sides 116 and 118 and bottom 103. Alternatively, in some embodiments, bag 100 is formed from a single plastic sheet having a side fold, a seal on the side opposite the side fold, and an end or bottom seal. In a further conventional construction, the bag 100 is formed from a closed tube that is flattened and sealed along the bottom 103. Other known techniques exist and are suitable.

Bag 100 can be constructed from a variety of plastics known to those of ordinary skill in the art. For example, bag 100 can be constructed from one or more thermoplastics, such as, but not limited to, polyethylene (e.g., low-density polyethylene), polyethylene terephthalate (PET), polypropylene, polystyrene, polyvinylidene chloride, mixtures of one or more of the foregoing polymers, and/or mixtures of one of the foregoing polymers with another thermoplastic polymer. The material of bag 100 can be transparent, translucent, or opaque.

FIG. 1 shows a bag 100 with substantially straight sides 116, 118 and bottom 103. If desired, the bottom 103 and/or one or both of the sides 116 and 118 can be contoured to provide a bag with alternate shapes. Furthermore, the bottom 103 and/or one or both of the sides 116 and 118 can be provided with a gusset for expansion purposes. Similarly, bag 100 can be a stand-up bag, in which the bottom of the bag has a gusset (e.g., a curvilinear or rectilinear gusset) or otherwise expandable portion. One example of such a stand-up bag is shown in U.S. Pat. No. 6,148,588, the contents of which patent are expressly incorporated by reference herein in their entirety.

Further in accordance with the invention, a reclosable fastener is provided along the mouth of the bag opposite the bottom. As shown in FIG. 1, fastener 107 includes a slider 113 that is slidably mounted to the tracks 109 and 111 for movement between an open position and a closed position to assist in opening and closing bag 100. The tracks 109 and 111 and the slider 113 can be similar to those described in U.S. Pat. No. 5,067,208 and U.S. patent Publication No. 2004/0066985, the contents of which documents are expressly incorporated by reference herein in their entireties. Alternatively, if desired, the fastener of bag 100 is opened and closed by finger pressure and/or an auxiliary squeezing device other than a slider 113. For example, in some of such embodiments, bag 100 includes a press-to-close type of fastener known to those of ordinary skill in the art. In another embodiment, bag 100 includes an adhesive, a cohesive, or mated dimples along the mouth of the bag 100 to serve as a reclosable fastener. Generally, bag 100 can include any suitable structure to effect a seal along the mouth of the bag 100.

Figure 2:
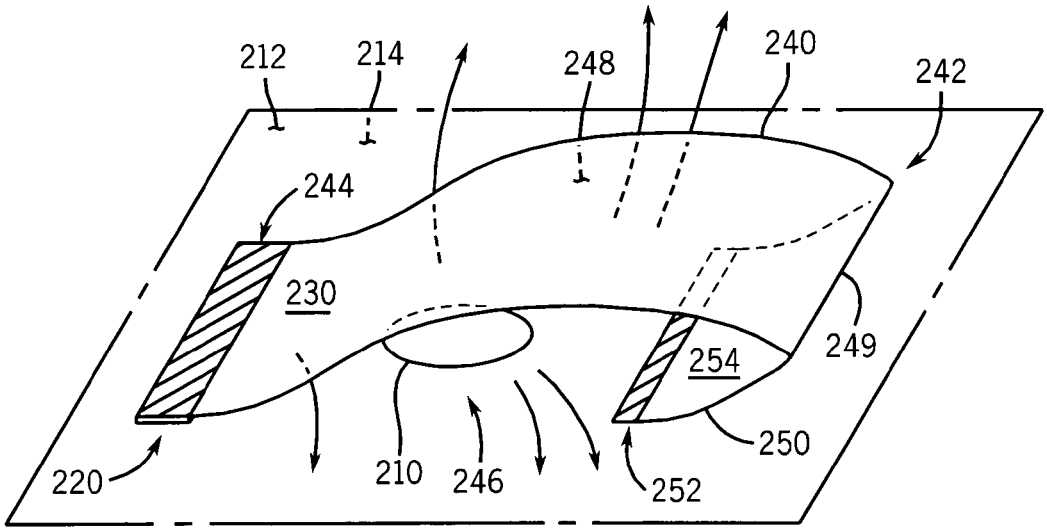
FIG. 2 is a perspective view of one representative embodiment of a pressure relief valve for a polymeric bag.

FIG. 2 is a perspective view of one embodiment of a pressure relief valve attached to a polymeric bag in accordance with the present invention, such as the polymeric bag shown and described with respect to FIG. 1. As shown in FIG. 2, a body panel 212 of the polymeric bag defines a pressure relief opening 210, 310, 410, 510 and a pressure relief valve 220 is disposed proximate the opening 210. As embodied herein, the valve 220 includes a cover member 230, 330, 430, 530 having a flexible upper layer 240 with first and second ends 242, 342, 442, 542 and 244, 344, 444, 544 and a lower layer 250. In its relaxed state, the upper layer 240 covers and seals the pressure relief opening 210, thereby inhibiting or preventing gases from passing through the opening 210. With reference to the embodiment of FIG. 2, the upper layer 240 is hingedly connected at its first end 242 to the lower layer 250 and is fixedly attached at its second end 244 to the body panel 212 so as to define at least one open side 246, 248 therebetween. The lower layer 250 includes a first portion 252 that is attached to the body panel 212 and a second portion 254 contiguous with the first portion 252, but not attached to the panel 212. The first end 242 is thus connected to the second portion 254 of the lower layer 250. In FIG. 2, the attachment of the first portion 252 to the body panel 212 is denoted schematically by cross-hatching. Similarly, in FIGS. 3-8, attachments are denoted by cross-hatching or dot matrices.

Generally, the valve 220 is configured to allow a flow rate of at least about 20 cubic inches of gas per second therethrough (i.e., about 325 cubic centimeters per second) upon application to the bag of a differential pressure of at least as low as about 0.3 pounds per square inch (i.e., about 2075 Pascals). As such, the valve 220 provides an improved gas flow rate upon application of relatively low pressures. Such valve embodiments can provide sealing times of at least about two days. These sealing times can be extended by suitable modifications, such as by applying sealing oil between the upper and lower layers 240 and 250, as further described herein with respect to FIG. 7.

As will be understood by those of ordinary skill in the art, operation of valve 220 is facilitated at least in part by the ability of the cover member 230 to bend, bulge, flex, and/or otherwise move away from the body panel 212 upon exit of gases through the pressure relief opening 210. Preferably, the cover member 230, i.e., each of the upper and lower layers 240 and 250, is formed from a semi-rigid plastic, such as, but not limited to, a thermoplastic material. For example, the cover member 230 can be formed from polypropylene, polyethylene, polystyrene, and/or other semi-rigid thermoplastics known to those of ordinary skill in the art. The cover member 230 can also be formed from semi-rigid thermoplastic materials known for their barrier penetration properties, such as, but not limited to, polyethylene terephthalate (PET).

The dimensions of the cover member 230 can vary, depending upon the material and expected operation environment. Generally, the cross-dimensions of the cover member 230 can be any suitable dimension for the bag, although a cross-dimension of between 1 inch (25.4 mm) and 1.125 inches (28.6 mm) is preferred.

As embodied herein, although not by limitation, each of the upper and lower layers 240 and 250 generally has a thickness less than about 0.016 inches (0.41 mm) and, preferably, between about 0.003 inches (0.076 mm) and about 0.006 inches (0.15 mm) to facilitate bending, bulging, flexing, and/or other movement of the cover layer 230 relative to the body panel 212 upon exit of gases through the pressure relief opening 210.

The dimension of the pressure relief opening likewise can vary depending upon application. It is noted, however, that larger pressure relief openings tend to facilitate exhalation of air and other gases, while smaller pressure relief openings 210 tend to restrict exhalation. The pressure relief opening 210 in a preferred embodiment of the present invention has a circular or oval shape and a cross-dimension (e.g., diameter) between about 0.125 inches (3.18 mm) and 0.5 inches (12.8 mm). Preferably, the valve 220 is positioned so that the opening 210 is substantially centered with respect to the ends 242 and 244 and the open sides 246 and 248 of valve 220, although other relative arrangements of the valve 220 and the opening 210 are possible.

As shown in FIG. 2, the cover member 230 is attached at its second end 244 to the body panel 212. The cover member 230 can be attached to the body panel 212 by an adhesive (e.g., rubber and resin) applied to the panel 212 and/or the second end 244 or by a heat seal, an ultrasonic weld, a cohesive, or the like. In a preferred embodiment, a pressure sensitive adhesive is used. Although the type of pressure sensitive adhesive depends on the application, the pressure sensitive adhesive can include an adhesive known to those of ordinary skill in the art to be capable of withstanding a range of temperatures from about 0° C. to about 50° C.

As previously described, the upper layer 240 is hingedly connected at its first end 242 to lower layer 250. As referred to herein, the term "hinged" refers to any suitable hinge-like connection in which the upper layer 240 can pivot, rotate or otherwise move with respect to the lower layer 250 at least in the region of the connection. In the embodiment shown in FIG. 2, cover member 230 is formed from a single plastic sheet that is folded on itself along a line of inflection 249 to form the upper and lower layers 240 and 250 as a unitary structure. Although not necessary, the cover member 230 can be folded on itself along a living hinge, a score line or a similar line of weakness, or a conventional fold line to form the upper and lower layers 240 and 250. Generally, to enhance the hinge-like effect of the attachment between the upper and lower layers 240 and 250, the first portion 252 of the lower layer 250 is attached to body panel 212, while the second portion 254 of the lower layer 250 is not, so as to be capable of moving away or lifting from the body panel 200. In some embodiments, the first portion 252 includes at least about 10% of the lower layer 250, although the proportion of the lower layer 250 that is comprised by the first portion 252 can vary depending upon application. Preferably, the first portion 250 is attached to the body panel 212 via a pressure-sensitive adhesive, although the first portion 250 can be attached by any suitable means, such as heat sealing, ultrasonic welding, a cohesive, or the like. As shown in FIG. 2, when air and other gases exit the bag through pressure relief opening 210, the upper layer 240 is capable of flexing outward due at least in part to the movement of the second portion 254 of the lower layer 250. In this manner, the pressure relief valve 220 opens and the gases exit through open sides 246 and 248, as indicated by arrows.

An exemplary method of operation of valve 220 will now be described. Initially, one or more items are placed inside the bag to which the valve is attached. For example, one or more items, such as, but not limited to, food items (e.g., cheeses or meats) or fabric items (e.g., clothing or dry cleaning), are placed inside the bag. The reclosable fastener of the bag is then placed in its closed position. For example, the slider of the bag is moved to its closed position, thereby engaging the male and female tracks to each other and closing the bag. At this time, air is captured within the bag. Pressure is applied to the bag, i.e., to one or more of the opposing body panels 212, 312, 412, 512 and 214, 314, 414, 514 causing air and other gases to exit the bag through pressure relief opening 210. Generally, a differential pressure of at least as low as about 0.3 pounds per square inch (i.e., about 2075 Pascals) can be applied to the bag to produce a flow rate of at least about 20 cubic inches of gas per second through the valve (i.e., about 325 cubic centimeters per second). The pressure exerted by the exiting gases causes cover layer 230 to bend, bulge, flex, or otherwise move away from body panel 212, preferably with the second portion 254 lifting from the body panel 212 to enhance air flow through the open sides 246 and 248 of the pressure relief valve 230. Once returned to its relaxed state, e.g., upon release of the pressure applied to the opposing body panels 212 and/or 214, the cover layer 230 returns to cover and seals the pressure relief opening 210, inhibiting or preventing flow of air and other gases into and out of the bag 100.

The disclosed bags with pressure relief valves of the present invention have a variety of applications. For example, the valves can be applied to bags configured for storing food items, such as meats, cheeses, and other perishables that are commonly stored in refrigerators or freezers. Also for example, the valves can be applied to bags configured for purging air and gases from clothing, such as bags configured for venting dry cleaning gases from dry cleaned clothing. Also for example, the valves can be applied to bags configured for compressing clothing and other fabrics for storage and/or transportation.

As will be understood by those of ordinary skill the art, a variety of configurations and constructions are possible for the valve shown in FIG. 2. For example, rather than being attached directly to the body panel 212 as shown in FIG. 2, the second end 244 of the upper layer 240 can be attached to a second lower layer that is similar to or a mirror of lower layer 250, thereby forming a doubly hinged valve configuration. Alternative configurations and constructions are discussed below with reference to FIGS. 3-5.

Figure 3:
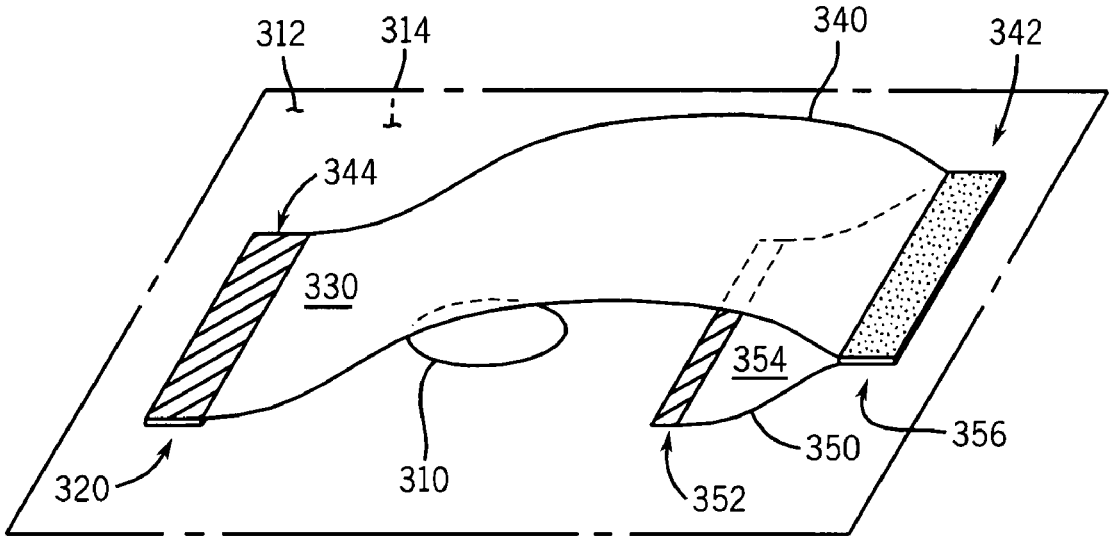
FIGS. 3-5 are perspective views of representative alternative embodiments of the pressure relief valve of the present invention.

FIG. 3 is a perspective view of an alternative embodiment of the pressure relief valve shown in FIG. 2. The valve 320 shown in FIG. 3 is similar in many respects to the valve 220 shown in FIG. 2. Unlike valve 220, however, cover member 330 is formed from two separate plastic sheets, in which one sheet forms upper layer 340 and the other sheet forms lower layer 350.

In the embodiment of FIG. 3, the lower layer 350 includes a first portion 352 that is attached to body panel 312 and a second contiguous portion 354 that is not attached to the body panel 312. A third contiguous portion 356 is defined opposite the first portion 352. The upper layer 340 is connected to the lower layer 350 at the third portion 356 to defined the hinged connection therebetween. As embodied herein, the upper layer 340 is connected to the lower layer 350 preferably via a heat seal, although a pressure sensitive adhesive, an ultrasonic weld, a cohesive, or the like can be used. The sheets that form the upper and lower layers 340 and 350 can be selected from the previously-described thermoplastic materials and should each have a suitable thickness to facilitate bending, bulging, flexing, and/or movement of the cover member 330 away from the body panel 312 as previously described. The dimension of the third portion 356, (i.e., the region of the upper and lower layers 340 and 350 that are preferably heat sealed to each other at end 342) can vary, depending upon the material and expected operational environment. Generally, the width of the third portion 356 can be any suitable dimension, although a cross width between about 0.125 inches (3.2 mm) and about 0.375 inches (9.5 mm) is preferred.

To further enhance the seal formed by upper layer 240, 340 over pressure relief opening 210, 310, it is beneficial to taper the thickness of the lower layer 250, 350.

Particularly, lower layer 250, 350 preferably has a minimum thickness proximate the first portion 252, 352 and a greater thickness proximate the second portion 254, 354 to minimize any gap that can form between upper layer 240, 340 and body panel 212, 312 when the upper layer 240, 340 is in the closed position. Alternative configurations are also available to enhance the seal formed by the upper layer 240, 340.

Figure 4:
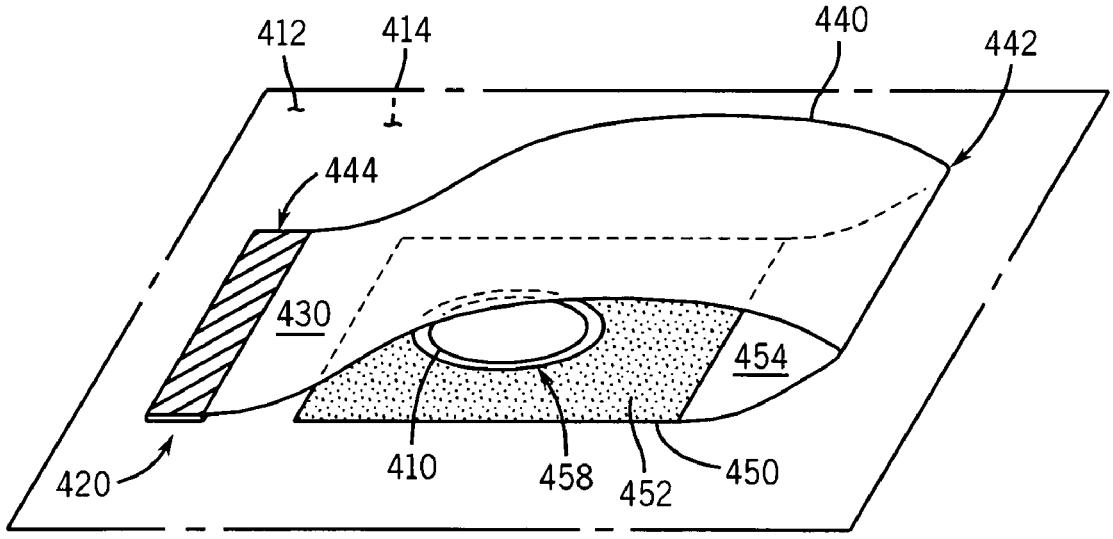

FIG. 4 is a perspective view of an alternative embodiment of the pressure relief valve shown in FIG. 2. The valve 420 shown in FIG. 3 is similar in many respects to the valve 220 shown in FIG. 2. Unlike valve 220, however, valve 420 includes a lower layer 450 that extends beyond pressure relief opening 410 defined by body panel 412.

As shown in FIG. 4, lower layer 450 defines an exit opening 458, 558, 658 and is attached to body panel 412 to be aligned in fluid communication with the pressure relief opening 410. Preferably, the relief and exit openings 410 and 458 are substantially concentric, and the exit opening 458 is at least equal to or larger (about 10-30% larger and, preferably, about 20% larger) than the size of the relief opening 410 to facilitate attachment of the valve 420 to body panel 412. The lower layer 450 includes a first portion 452 that is attached to the body panel 412 and a second contiguous portion 454 that is not attached to the body panel 412. Preferably, the lower layer 450 is attached to the body panel 412 substantially completely around the pressure relief opening 410 and exit opening 458 to inhibit or prevent gas flow between the lower layer 450 and the body panel 412.

In some embodiments, a pressure-sensitive adhesive is applied to the first portion 452 of the lower layer 450 in the assembled valve 420, and the assembled valve 420 is applied to a bag having a pressure relief opening 410. Preferably, in such embodiments, the pressure-sensitive adhesive is not applied to a region of the first portion 452 that surrounds the exit opening 458 to inhibit or prevent the adhesive from contacting the pressure relief opening 410 and/or food items stored inside the bag upon misalignment of the valve 420, i.e., the exit opening 458, with the pressure relief opening 410.

As will be understood by those of ordinary skill in the art, the upper and lower layers 440 and 450 of valve 420 can be formed from a single plastic sheet (similar to valve 220 shown in FIG. 2) or, alternatively, from two separate plastic sheets (similar to valve 320 shown in FIG. 3).

Figure 5:
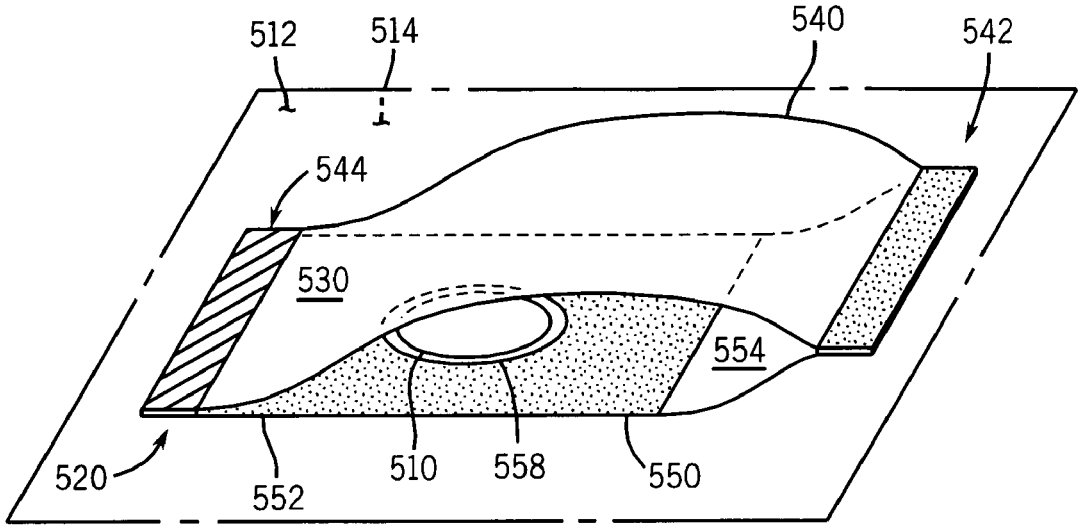

FIG. 5 shows a perspective view of a preferred embodiment of the pressure relief valve shown in FIG. 2. The valve 520 shown in FIG. 5 is similar to the valve 220 of FIG. 2. Unlike valve 220, however, cover member 530 includes co-extensive upper and lower layers 540 and 550.

In the embodiment of FIG. 5, the upper and lower layers 540 and 550 are connected together along first ends 542 and second ends 544. Additionally, and as depicted in this embodiment, the lower layer 550 can be connected to the panel 512 such that the second end 544 is substantially immovable relative to the panel 512 and form a singly hinged valve configuration similar to that of FIG. 3. For example, the lower layer 550 includes a first portion 552, adjacent the second ends 544, that is attached to the body panel 512 (preferably, via a pressure sensitive adhesive or the like) and a second contiguous portion 554, adjacent the first ends 542, that is not attached to the body panel 512. Additionally, if desired the bottom surface of the second end 544 of the lower layer 550 can be attached directly to the panel 512.

Alternatively, the upper and lower layers 540 and 550 can be connected to each other, but not to the body panel 512, along both the first ends 542 and the second ends 544 to form a doubly hinged valve configuration (not shown). That is, a third portion, not attached to the panel 512, can be provided contiguous with and between the first portion 552 and the second end 544 of the lower layer 550. As will be understood by those of ordinary skill in the art, the upper and lower layers 540 and 550 of valve 520 can be formed from a single plastic sheet (similar to valve 220 shown in FIG. 2) or, alternatively, from two separate plastic sheets (similar to valve 320 shown in FIG. 3).

The pressure relief openings and pressure relief valves disclosed herein with respect to FIGS. 2-5 can be disposed in any of a variety of locations on a body panel of a polymeric bag. For example, the valve can be attached near sides, middles, bottoms, or tops of body panels without experiencing significant adverse effects on functionality. In a preferred embodiment, the valve is attached closer to the mouth and reclosable fastener of the bag than to the bottom of a bag and, preferably, within about 10 cm of the reclosable fastener. In a more preferred embodiment, the valve is placed proximate a corner of the bag, e.g., a corner of the bag formed by the intersection of one of the opposing sides with the fastener or the bottom of the bag. Disposing the valve proximate a corner of the bag allows air and other gases contained in the bag to be efficiently pushed to the corner of the bag and vented therefrom.

In accordance with another aspect of the invention, a bag is provided with a pressure relief opening, a pressure relief valve, and a seal line extending proximate the pressure relief opening. Particularly, the seal line at least partially attaches the first and second body panels of the bag together. The seal line extends from or proximate the pressure relief opening to a location beyond the pressure relief valve. In this manner, when pressure is applied to the bag to open the pressure relief valve, a dimple is formed in the panel proximate the pressure relief valve to enhance the flow of air therefrom.

Figure 6A:
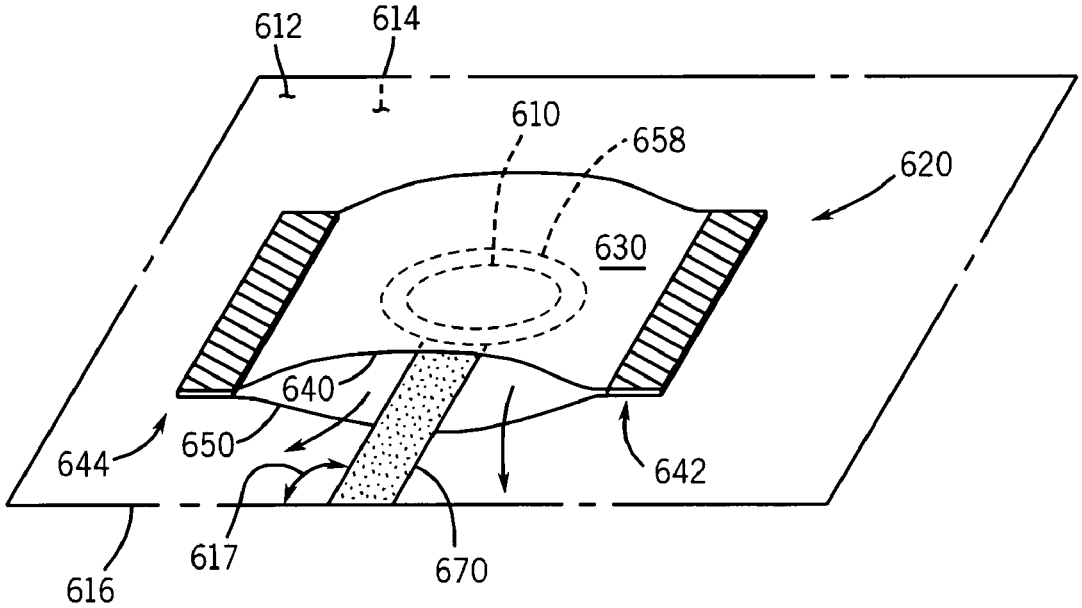
FIGS. 6A and 6B are perspective views of other aspects of the present invention.
Figure 6B:
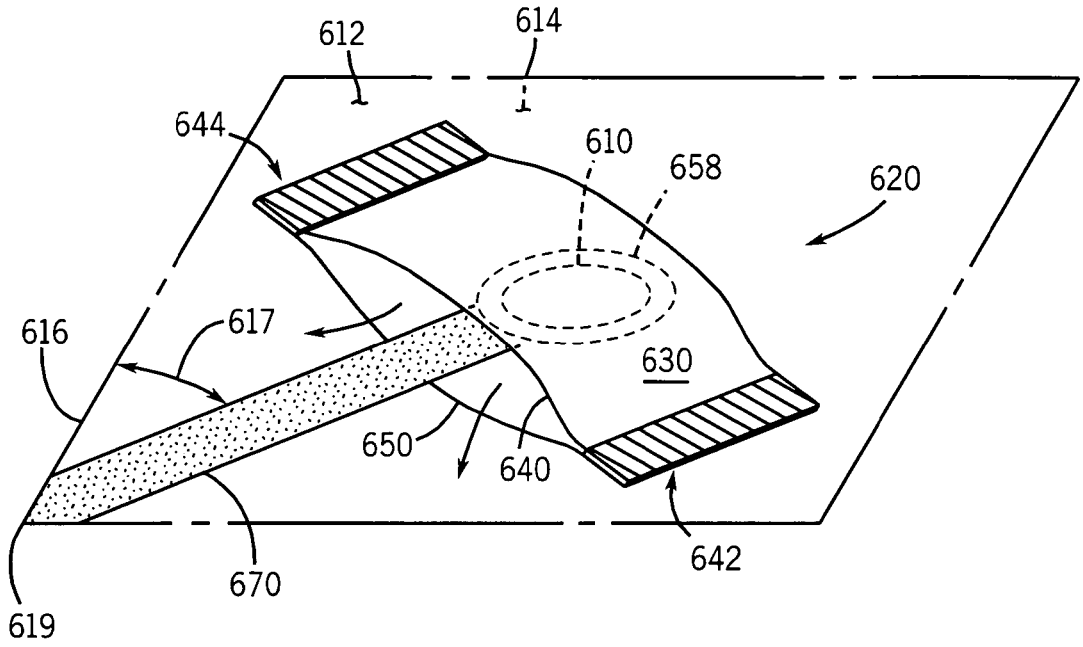

FIGS. 6A and 6B are perspective views of a representative embodiment of a bag having a pressure relief valve in accordance with this aspect of the invention. The bag is conventional in construction, as described with respect to FIG. 1. As shown in FIGS. 6A and 6B, a body panel 612 of the polymeric bag defines a pressure relief opening 610, and a seal line 670 at least partially attaches the body panel 612 to its opposing body panel 614. The seal line 670 extends proximate the opening 610 towards an edge of the bag, e.g., bag side 616. In a preferred embodiment, as shown in FIG. 6B, the seal line 670 is inclined at an angle 617 to bag side 616, and the pressure relief valve 620 is disposed proximate the opening 610. Preferably, a valve configuration similar to one described with respect to FIGS. 1-5 is provide in combination with the seal line. For example, pressure relief valve 620 preferably includes a cover member 630 having an upper layer 640 and a lower layer 650, connected together to form either a singly or doubly hinged valve configuration as previously described herein. Alternatively, if the seal line 670 defines a suitable dimple for the release of purged air from the pressure relief opening 610, then the cover member 630 need not included a hinged connection as previously described. That is, the cover member 630 can be fixedly connected at either end 642, 644 directly to the panel 612 or the lower layer 650, if provided.

As shown in FIGS. 6A and 6B, the pressure relief valve 620 is positioned with respect to the opening 610 so that the lower layer 650 at least partially overlaps the seal line 670. Preferably, the opposing ends 642 and 644 of the valve 620 are substantially parallel to the seal line 670. A variety of additional or alternative arrangements of the valve 620 also are possible in accordance with the present invention.

As will be understood by those of ordinary skill in the art, the seal line 670 forms a dimple in the bag that facilitates venting of gases from the bag. During operation, pressure is applied to the bag (e.g., body panel 612 and/or its opposing body panel 614) while the reclosable fastener of the bag is in its closed position, thus causing air and other gases inside the bag to concentrate in the region of the dimple. This concentration contours the panel of the bag generally into a hill-valley-hill arrangement, in which the valley is aligned with the pressure relief opening. Such a concentration urges the cover layer 630 open, allowing the concentrated air and gases inside the bag to vent to the exterior of the bag, as indicted by arrows in FIG. 6A. The opening of the cover layer 630 can be designed to be accompanied by an audible popping sound.

As previously indicated, the seal line 670 preferably extends from the opening 610 towards the bag side 616 and is inclined at an angle 617 with respect to the side. More preferably, as shown in FIG. 6B, the seal line 670 extends from the opening 610 to a corner 619 of a bag at an angle 617 of about 45 degrees (±15 degrees) with respect to a side 616 of the bag adjacent the corner 619 to enhance the effects of gas concentration in the region of the "dimple" formed by the seal line 670. If desired, however, the seal line 670 can extend from the pressure relief opening 610 towards any portion of the bag, including a portion disposed proximate to or spaced apart from an edge of the bag (e.g., a side, a bottom, or a top of the bag), without significantly adversely affecting the functionality of the valve 620.

In accordance with another aspect of the present invention, the cover member can include further modifications to enhance the seal formed between the cover member and the corresponding panel of the bag. Particularly, the cover member can be provided with surface modifications to effectuate an improved seal. The surface modifications preferably are included on at least the upper layer or the base layer, if provided.

As previously described, each of the cover members of the valves shown in FIGS. 4 and 5 can include a lower layer that extends beyond the pressure relief openings defined by the body panels to which the valves are attached. For example, FIGS. 4 and 5 show lower layer 450, 550 that extends beyond and around the pressure relief opening 410, 510 formed in body panel 412, 512. The lower layer 450, 550 defines an exit opening 458, 558 aligned in fluid communication with the relief opening 410, 510.

Figure 7:
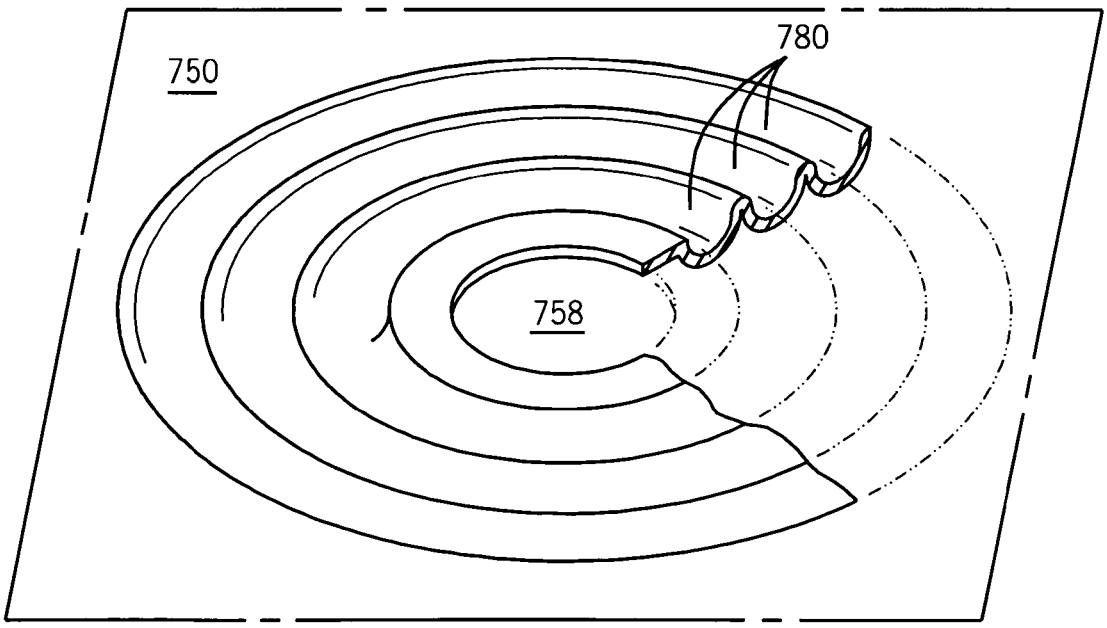
FIG. 7 is a perspective view of an additional aspect of the present invention, as shown on the lower layer of the pressure relief valve shown in FIGS. 4 and 5.

FIG. 7 is a perspective view of a representative embodiment of a surface modification provided on a lower layer of the pressure relief valve shown in FIGS. 4 and 5. As shown in FIG. 7, the lower layer 750 includes an exit opening 758 and one or more indentations or troughs 780 that are disposed around the exit opening 758. Preferably, the troughs 780 are formed to be substantially concentric with each other and with the exit opening 758. Although concentric rings are shown, alternative configurations for the indentations can be used.

In one embodiment, the troughs 780 are configured to receive a sealing oil, such as, but not limited to, mineral oil, vegetable oil, and silicone-based oils. The concentric arrangement of the troughs 780 and the sealing oil enhance the strength of a seal formed in a pressure relief valve between the lower layer 750 and a cover layer in its relaxed state.

The troughs 780 can be thermally formed in the lower layer 750 using techniques known to those of ordinary skill in the art.

In some embodiments, the troughs are less than about 0.050 inches (1.25 mm) wide, and less than about 0.015 inches (0.4 mm) deep, as measured from the surface of the lower layer 750, although the sizes and depths of the troughs 780 can vary based on materials and applications.

Alternatively, troughs similar to troughs 780 of lower layer 750 can be formed in the body panel around the pressure relief opening if the cover member does not include a base layer that extends beyond and surrounds the pressure relief opening. Such troughs formed in the panel can be implemented with valve embodiments shown in FIGS. 2, 3, 6A, and 6B.

Additionally or alternatively, indentations can be formed in the upper layer of the cover member. If formed on both the upper and lower layers of the cover member, the indentations can further be aligned in a mating or interlocking configuration.

The disclosed bags with pressure relief valves can be constructed using any of a variety of methods and techniques known to those of ordinary skill in the art. For example, the pressure relief valves are preferably formed separately from the bags. Such pre-formed valves can be stored on a roll, in which each valve is attached to the roll via a pressure sensitive adhesive and/or other mechanisms known to those of ordinary skill in the art. In some embodiments, such pre-formed valves can be attached to the bags prior to or during production of the bags. For example, in one such embodiment, a bag material is provided and a pressure relief opening is cut, punched, or otherwise formed in the bag material prior to folding the bag material. Prior to or simultaneous with the formation of the bag, the pre-formed pressure relief valve is attached to the bag proximate the pressure relief opening via a known technique, such as a pressure sensitive adhesive, a heat seal, or an ultrasonic weld, as previously described. Alternatively, pre-formed valves can be retrofitted to the bag after production of the bag. For example, in one such embodiment, a pressure relief opening is cut, punched, or otherwise formed in a body panel of a formed bag, and the pre-formed pressure relief valve is then attached to the bag proximate the pressure relief opening.

While the disclosed pressure relief valves have been shown and described with reference to the illustrated embodiments, those of ordinary skill in the art will recognize and/or be able to ascertain many equivalents to those embodiments. Such equivalents are encompassed by the scope of the present disclosure and the appended claims.

Unless otherwise provided, when the articles "a" or "an" are used herein to modify a noun, they can be understood to include one or more than one of the modified noun.

The invention claimed is:

1. A polymeric bag comprising:

first and second opposing body panels attached to each other along a pair of opposing sides and a bottom bridging the sides, a reclosable fastener extending along a mouth formed opposite the bottom and including a pair of interlocking tracks, a pressure relief opening defined in the first body panel, and a pressure relief valve attached to the first body panel and including a cover member to cover the pressure relief opening, the cover member including an upper layer and a lower layer, the upper layer being connected at a first end to the lower layer, the lower layer including a first portion attached to the body panel and a second portion contiguous with the first portion but not attached to the body panel, the first end of the upper layer hingedly connected to the second portion of the lower layer, and a second end of the upper layer of the cover member is fixedly attached to the first portion of the lower layer on a side of the pressure relief opening opposite the first end.

2. The polymeric bag of claim 1, wherein the upper layer and the lower layer are co-extensive and the lower layer includes an exit opening defined therein, the first portion of the lower layer being attached to the first body panel such that the exit opening and the pressure relief opening are aligned in fluid communication.

3. The polymeric bag of claim 2, wherein the first portion of the lower layer includes two or more troughs formed therein, the troughs being concentric with the exit opening, the troughs being at least partially filled with a sealing oil.

4. The polymeric bag of claim 3, wherein the troughs are formed thermally.

5. The polymeric bag of claim 1, wherein at least one of the upper layer and the lower layer is formed from a plastic from the group consisting of polypropylene, polyethylene, polystyrene, and polyethylene terephthalate.

6. The polymeric bag of claim 1, wherein each of the upper layer and the lower layer has a thickness less than about 0.016 inches (0.41 mm).

7. The polymeric bag of claim 1, wherein the pressure relief opening has a cross-dimension between about 0.125 inches (3.18 mm) and about 0.5 inches (12.8 mm).

8. The polymeric bag of claim 1, wherein the pressure relief valve is disposed nearer to the reclosable fastener than to the bottom.

9. The polymeric bag of claim 1, wherein the pressure relief valve is configured to allow a flow rate of at least about 20 cubic inches (325 cubic centimeters) per second of gas therethrough upon application of a differential pressure of at least about 0.3 pounds per square inch (2075 Pascals) to the bag.

10. A polymeric bag comprising:

first and second opposing body panels attached to each other along a pair of opposing bag sides and a bottom bridging the pair of sides, a reclosable fastener extending along a mouth formed opposite the bottom and including a pair of interlocking tracks, a pressure relief opening defined in the first body panel, a seal line at least partially attaching the first and second opposing body panels together and extending proximate the pressure relief opening toward a corner of the bag and inclined at an angle with respect to one of the opposing bag sides, and a pressure relief valve attached to the first body panel and including a cover member to cover the pressure relief opening, the cover member including an upper layer and a lower layer, the upper layer connected at a first end to the lower layer, the lower layer including a first portion attached to the body panel and a second portion contiguous with the first portion but not attached to the body panel, the first end of the upper layer hingedly connected to the second portion of the lower layer, and a second end of the upper layer of the cover member is fixedly attached on the side of the pressure relief opening opposite the first end.

11. The bag of claim 10, wherein the lower layer at least partially overlaps the seal line.

12. The bag of claim 10, wherein the first end of the upper layer is substantially parallel with the seal line.

13. A polymeric bag comprising:

first and second opposing body panels attached to each other along a pair of opposing sides and a bottom bridging the sides, a reclosable fastener extending along a mouth formed opposite the bottom and including a pair of interlocking tracks, a pressure relief opening defined in the first body panel, and a pressure relief valve attached to the first body panel and including a cover member to cover the pressure relief opening, the cover member including an upper layer and a lower layer, the upper layer being connected at a first end to the lower layer, the lower layer including a first portion attached to the body panel and a second portion contiguous with the first portion but not attached to the body panel, the first end of the upper layer hingedly connected to the second portion of the lower layer and a second end of the upper layer fixedly attached to the first portion of the lower layer on a side of the pressure relief opening opposite the first end, the cover member having a first position sealing the pressure relief opening and a second position spaced from the pressure relief opening when pressure is selectively applied to the bag to release gases therefrom, the cover member returning to the first position without pressure selectively applied to the bag.

14. The polymeric bag of claim 13, wherein the upper layer and the lower layer are co-extensive and the lower layer includes an exit opening defined therein, the first portion of the lower layer being attached to the first body panel such that the exit opening and the pressure relief opening are aligned in fluid communication.

15. The polymeric bag of claim 14, wherein the first portion of the lower layer includes two or more troughs formed therein, the troughs being concentric with the exit opening, the troughs being at least partially filled with a sealing oil.

16. The polymeric bag of claim 15, wherein the troughs are formed thermally.

17. The polymeric bag of claim 13, wherein at least one of the upper layer and the lower layer is formed from a plastic from the group consisting of polypropylene, polyethylene, polystyrene, and polyethylene terephthalate.

18. The polymeric bag of claim 13, wherein each of the upper layer and the lower layer has a thickness less than about 0.016 inches (0.41 mm).

19. The polymeric bag of claim 13, wherein the pressure relief opening has a cross-dimension between about 0.125 inches (3.18 mm) and about 0.5 inches (12.8 mm).

20. The polymeric bag of claim 13, wherein the pressure relief valve is disposed nearer to the reclosable fastener than to the bottom.

21. The polymeric bag of claim 13, wherein the pressure relief valve is configured to allow a flow rate of at least about 20 cubic inches (325 cubic centimeters) per second of gas therethrough upon application of a differential pressure of at least about 0.3 pounds per square inch (2075 Pascals) to the bag.

* * * * *